US006568118B1

(12) United States Patent
Teetzel

(10) Patent No.: US 6,568,118 B1
(45) Date of Patent: May 27, 2003

(54) GRENADE LAUNCHER SIGHTING ASSEMBLY

(76) Inventor: James W. Teetzel, 125 Aviation Ave., Blg. #2, Portsmouth, NH (US) 03801

( * ) Notice: Subject to any disclaimer, the term of this patent is extended or adjusted under 35 U.S.C. 154(b) by 91 days.

(21) Appl. No.: 09/767,581

(22) Filed: Jan. 22, 2001

Related U.S. Application Data

(63) Continuation-in-part of application No. 09/158,441, filed on Sep. 21, 1998, now abandoned.
(60) Provisional application No. 60/059,722, filed on Sep. 22, 1997.

(51) Int. Cl.[7] ..... F41G 1/36; F41G 3/14
(52) U.S. Cl. ..... 42/105; 42/136; 42/138; 42/114; 89/41.17
(58) Field of Search ..... 42/105, 135, 136, 42/138, 130, 131, 146, 148, 100, 114; 89/41.17

(56) References Cited

U.S. PATENT DOCUMENTS 3,553,843 A * 1/1971 Sophinos et al. ..... 42/100
4,214,372 A * 7/1980 Rusbach ..... 42/105
5,659,965 A * 8/1997 Thibodeau et al. ..... 42/100

FOREIGN PATENT DOCUMENTS

DE 1075987 * 2/1960 ..... 42/105
GB 340756 * 1/1931 ..... 42/105

* cited by examiner

*Primary Examiner*—Stephen M. Johnson
(74) *Attorney, Agent, or Firm*—William B. Ritchie

(57) ABSTRACT

A grenade launcher sighting assembly. A sighting apparatus for a grenade launcher having a barrel with a centerline is provided. The sighting apparatus has a mounting module that is alignable mountable to the barrel of the grenade launcher, wherein said mounting module is adapted to be attached to the barrel of the grenade launcher such that mounting module is consistently aligned with the centerline of the barrel. An adjustable range gradient is also provided. The adjustable range gradient is pivotally attached to said mounting module, wherein said range gradient has selectable a plurality of selectable positions, such that each selectable position has a yardage value and such that each selectable position corresponds to a particular trajectory wherein said grenade launcher will launch a grenade a distance that corresponds to the yardage value of selected position of said range gradient.

15 Claims, 14 Drawing Sheets

GRENADE LAUNCHER SIGHTING ASSEMBLY

This application is a continuation-in-part of the U.S. patent application Ser. No. 09/158,441, filed Sep. 21, 1998, now abandoned, which has a priority date based on U.S. patent application Ser. No. 60/059,722, filed Sep. 22, 1997.

FIELD OF THE INVENTION

The invention relates to sights for use on grenade launchers, particularly grenade launchers that are attached to assault rifles such as the M-16.

BACKGROUND OF THE INVENTION

It is well known to use mechanical sights to target a projectile. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus while maintaining even pressure on the barrel of the gun and depressing the trigger to fire a round. These skills require tremendous practice, with each shot fired needing the utmost concentration if the shooter is to obtain maximum accuracy. It is even far more difficult to hit a target when the projectile has a trajectory that features a curve that has a large arc as found with projectiles such as grenades.

The same problems inherent in mechanical sights face a soldier in a combat situation. While a rifle is inherently more accurate that a handgun, the stress of combat, the need to fire rapidly but accurately in order to survive is sufficient to introduce substantial errors into the sighting process. These problems are further exacerbated by the fact that most military personnel do not have sufficient practice time with their weapon to develop a high proficiency, particular in combat simulated situations. Again, this problem is compounded when the difficulty in compensating for a high arcing trajectory.

A solution to this problem for handguns has been the introduction of laser sights. This type of system can also improve accuracy using a grenade launcher. The typical laser sight is mounted on the top on the handgun or on the bottom. The laser sight, when properly aligned, places a red light dot on the target where the bullet will strike if the gun is fired. Using this type of sight enables the shooter to rapidly, instinctively, and properly position the weapon and be certain of his/her intended target. Using a laser sight enables accurate shots to be fired at distances of more than 50 feet, sufficient for most combat or law enforcement situations requiring the use of handguns.

However, prior art laser devices have several disadvantages. First, a laser sight for a standard military issue weapon, such as the M-16, mounts on the weapon, not the grenade launcher itself. Thus, misalignment or movement between the barrel of the grenade launcher and the rifle results in less accurate firing. Also, current devices do not provide a mount that can be attached to the grenade launcher without requiring a major modification of the firearm. Also, standard laser modules are specifically designed for mounting on a Picatinny rail and limited to use with just one weapon. The laser sight is boresighted to the weapon and not meant to be repeatedly removed and, if the laser module is moved to a different weapon platform, the lengthy and elaborate boresighting procedure must be redone. This is particularly true with infrared laser aiming modules and has, in large part, limited the applicability of laser sights to fixed mounted sights on specific weapons. Third, the use of a powered laser requires that a power source be readily available which has resulted in bulky units or units requiring special batteries to run.

A grenade launcher sighting assembly traditionally uses iron sights only. Such sights, while durable, lack the accuracy and ease of use found with modem laser and reflex sights.

A grenade launcher sighting assembly that can be used with various laser or reflex sights which can be used day or night, has built-in back iron sights, is attachable to the grenade launcher barrel, thereby providing greater accuracy, has an illuminated range gradient, features a lighted anti-cant indicator, and has a built-in ambidextrous pressure pad switch for operating standard military laser and reflex sights and other Picatinny mountable accessories, is not found in the prior art.

SUMMARY OF THE INVENTION

The present invention is a grenade launcher sighting assembly. A sighting apparatus for a grenade launcher having a barrel with a centerline is provided. The sighting apparatus has a mounting module that is alignable mountable to the barrel of the grenade launcher, wherein said mounting module is adapted to be attached to the barrel of the grenade launcher such that mounting module is consistently aligned with the centerline of the barrel. An adjustable range gradient is also provided. The adjustable range gradient is pivotally attached to said mounting module, wherein said range gradient has selectable a plurality of selectable positions, such that each selectable position has a yardage value and such that each selectable position corresponds to a particular trajectory wherein said grenade launcher will launch a grenade a distance that corresponds to the yardage value of selected position of said range gradient.

It is an aspect of the present invention to provide a grenade launcher sighting assembly that is useable with standard laser or reflex sights and which can be mounted on said assembly.

It is another aspect of the present invention to provide a grenade launcher sighting assembly that can be used with a laser or flex sight and wherein the mounted laser or reflex sight can also be used as the primary sight for the 5.56 mm rifle that the grenade launcher is mounted upon.

It is another aspect of the present invention to provide a grenade launcher sighting assembly that has an illuminated anti-cant indicator.

Another aspect of the present invention is to provide a grenade launcher sighting assembly that has a Mil-Std-1913 Picatinny rail interface where sighting devices or other accessories can be easily mounted thereto.

It is an aspect of the invention to provide a grenade launcher sighting assembly that can be used with a power handgrip which supplies power to the assembly using standard, commercially available, batteries.

It is another aspect of the present invention to provide a grenade launcher sighting assembly that is water resistant.

It is also another aspect of the present invention to provide a grenade launcher sighting assembly that has back-up iron sights.

Still another aspect of the present invention is to provide a grenade launcher sighting assembly wherein the back-up iron sights are collapsible and provide a low profile when collapsed to prevent the iron sights from catching on brush or other obstacles encountered during use.

Still another aspect of the present invention is to provide a grenade launcher sighting assembly where the back-up iron sights have substantial sight radius and wherein both front and rear sight positions are fully adjustable.

Another aspect of the present invention is to provide a grenade launcher sighting assembly having a range gradient is illuminated and has a night and day selectable setting.

Another aspect of the present invention is to provide a grenade launcher sighting assembly where the range gradient can be locked into position by a spring loaded mechanism and then easily readjusted by a simple lever release mechanism.

Finally, it is an aspect of the present invention to provide a grenade launcher sighting assembly where an L-bracket can be added so that another Picatinny rail is provided for additional accessories such as a laser or reflex sight, flashlight, infrared equipment, etc.

Another aspect of the present invention is to provide a grenade launcher sighting assembly having a handgrip in which batteries are housed in a waterproof housing requiring no special tools to access.

It is another aspect of the invention to provide a handgrip which indicates the blink rate of the laser and the remaining battery life.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
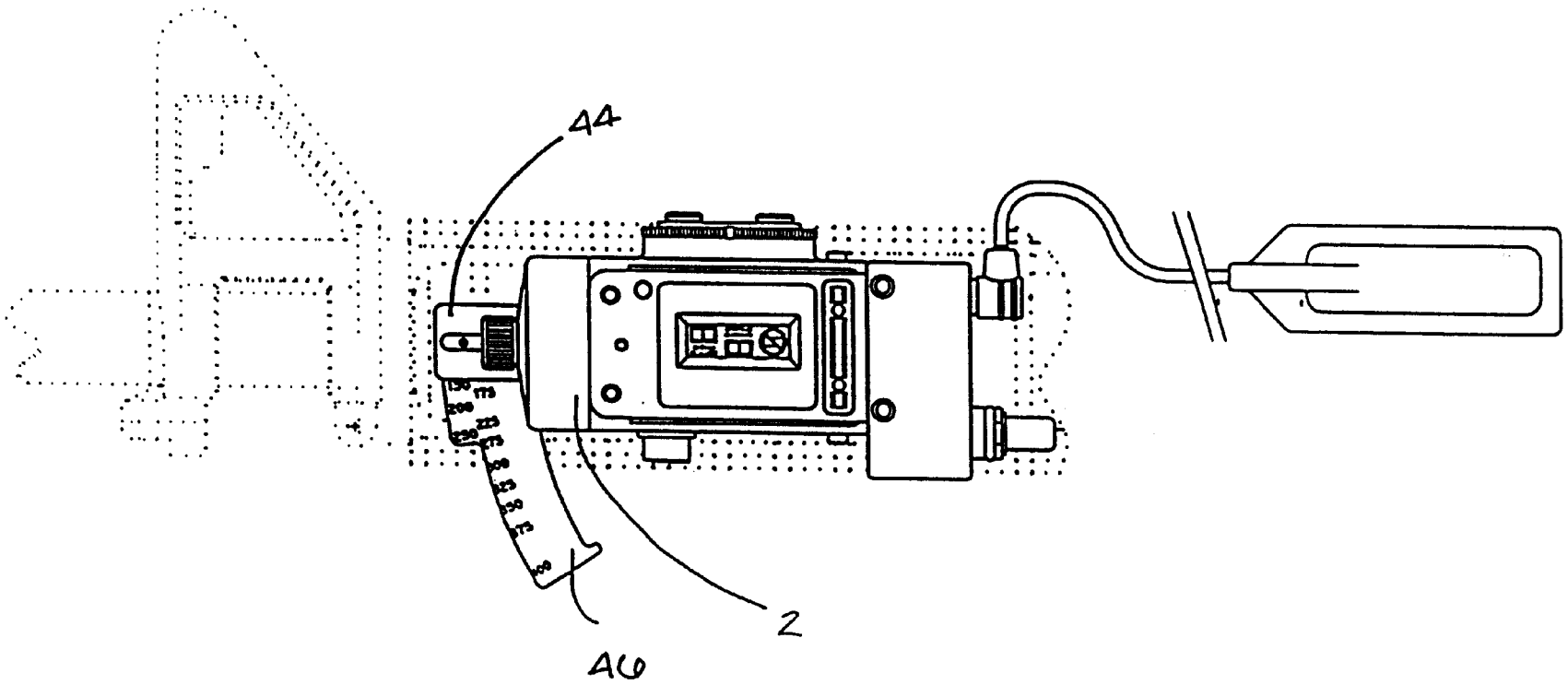
FIG. 1 is a side view of the grenade launcher sighting assembly with a embodiment of the laser and mounting modules mounted to an assault rifle.
Figure 3:
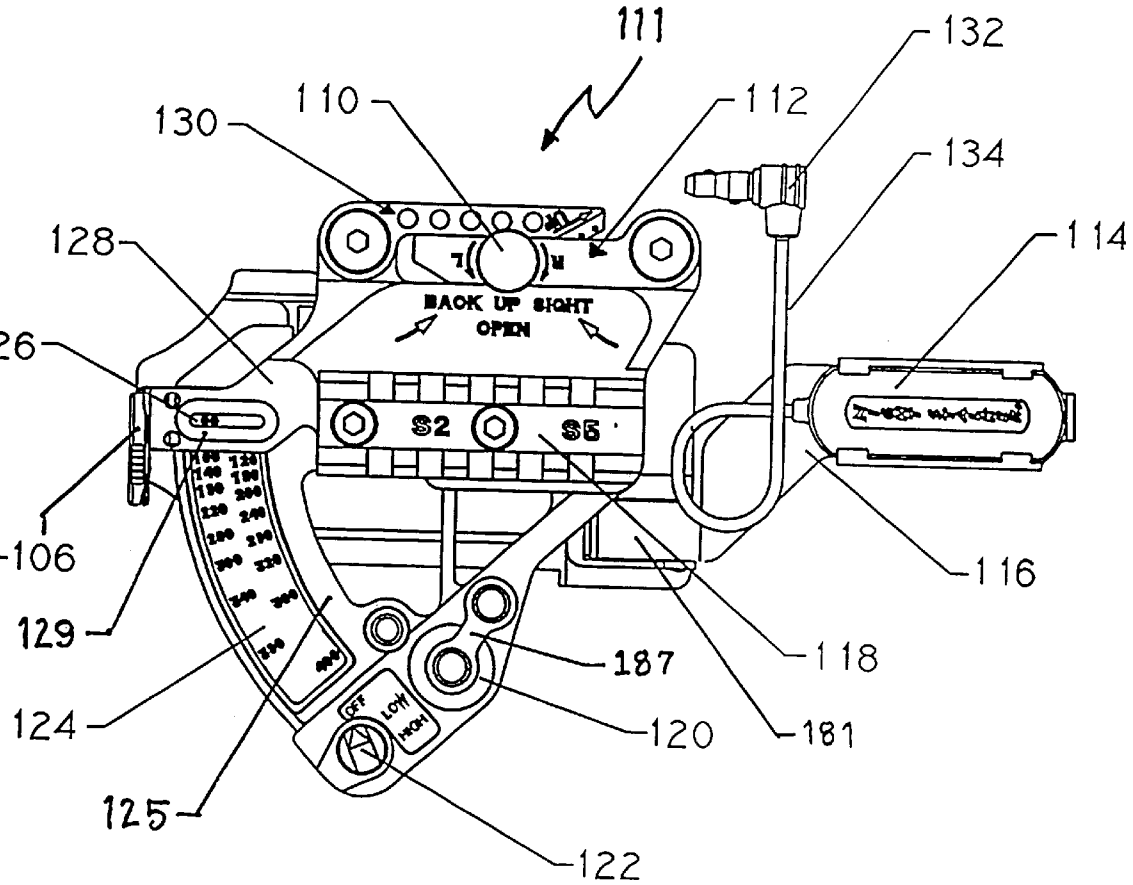
FIG. 3 is a left side view of the preferred embodiment of the grenade launcher sighting assembly.

Referring now to FIG. 1–8, a side view of the grenade launcher sighting apparatus with a laser shown mounted to an assault rifle 24. The embodiment of FIG. 1 is similar in all respects the embodiment of FIGS. 14, 15, except for the mounting module 44. In this case, mounting module 44 includes a protractor style range finder 46 instead of the dial style range finder 12 of FIGS. 14, 15.

In operation, the embodiment of FIG. 1 has two primary uses. With the laser module 2 aligned to the zero (0) meters marker on the range finder 46, the laser functions as a standard laser sight for the rifle. With the laser module 2 aligned to another distance on the range finder 46, the laser module 2 can also be used to sight an attached grenade launcher (not shown).

Figure 2:
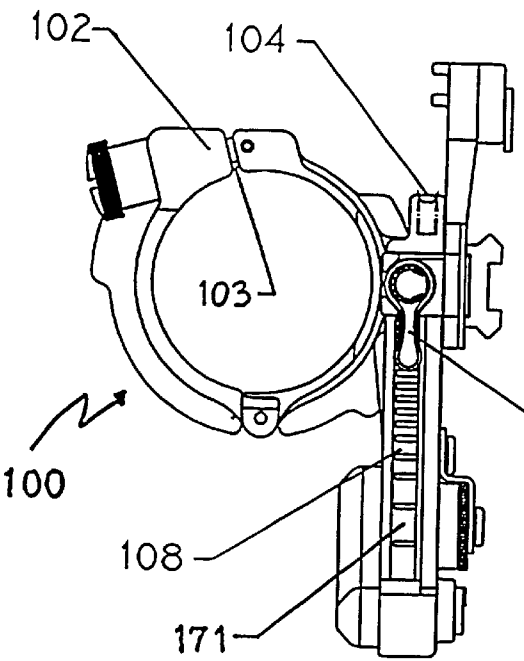
FIG. 2 is a front view of the preferred embodiment of the grenade launcher sighting assembly in accordance with the invention.
Figure 9:
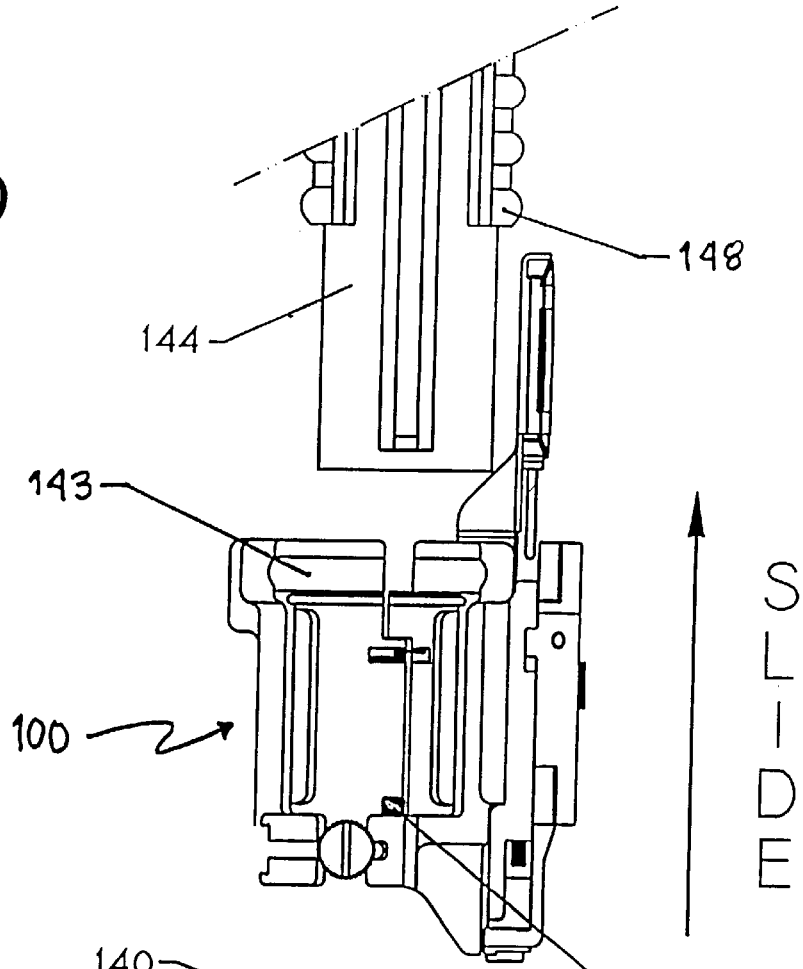
FIG. 9 is a top view of the mounting assembly that is being slid onto a grenade launcher.
Figure 10:
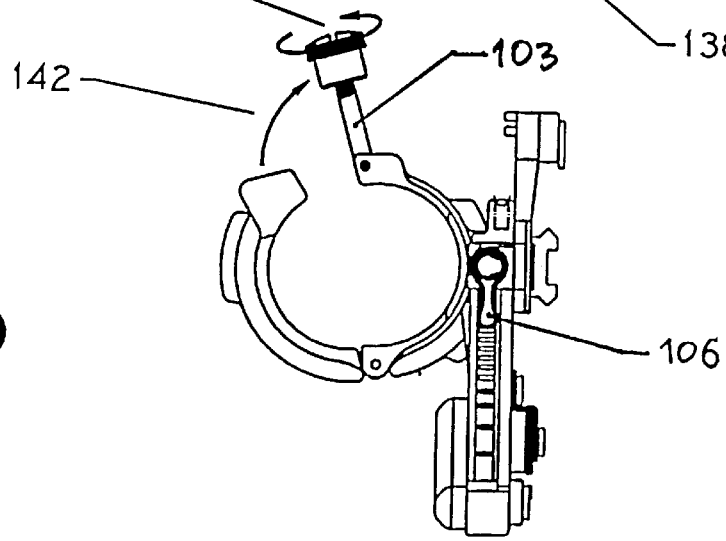
FIG. 10 is a front view of the grenade launcher with barrel interface assembly in the open position.
Figure 12:
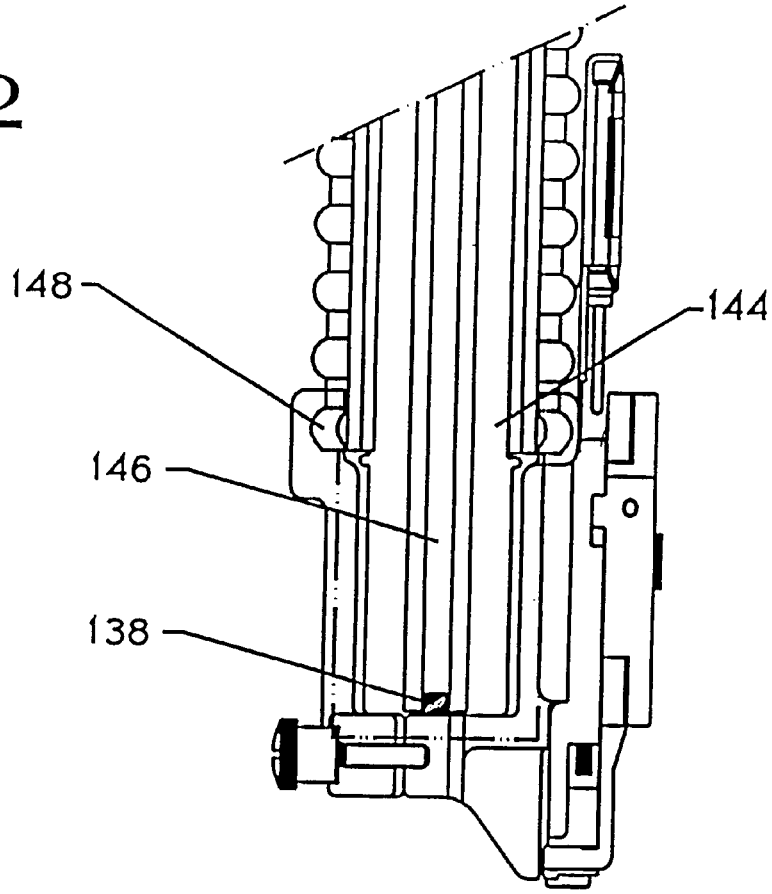
FIG. 12 is a view of the grenade launcher sight assembly attached to a grenade launcher.
Figure 13:
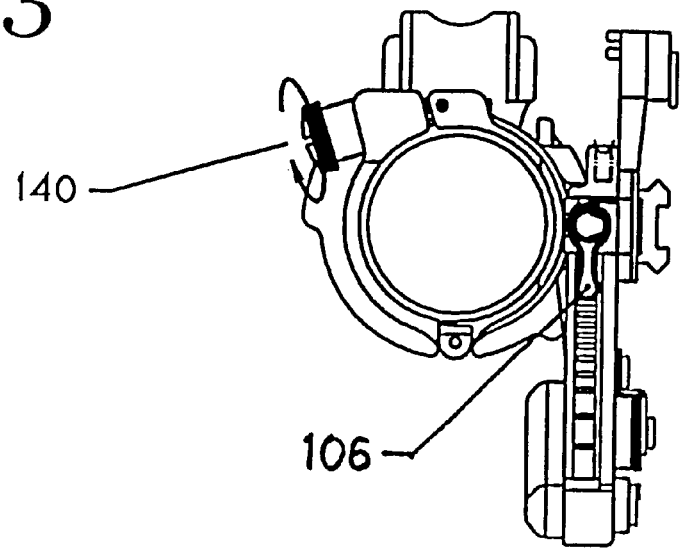
FIG. 13 is a detailed view of the barrel interface assembly 100.

As shown in FIG. 2, barrel interface assembly 100 is the part of mount 111 that attaches directly to M203 and M203 QD Grenade Launcher barrel 101. It attaches to the outside diameter of grenade launcher barrel 101 and first rib 148 of the forearm grip 144 (see FIGS. 9 and 12) easily, quickly, and without use of tools. As can be seen, rib 148 fits within slot 143 which is dimensioned to correspond to rib 148 so that the barrel interface assembly 100 will stay firmly in position once it is attached.

The left side of the barrel interface assembly 100 contains the launcher alignment pin 103 and thumb nut assembly 102. Once alignment pin 103 is engaged with thumb nut assembly 102, thumb nut 140 is merely tightened by hand to fasten the apparatus securely to grenade launcher barrel 101.

Selector Switch 122 is used to set the intensity of the light emitting from illuminated range gradient 124 and anti-cant 104 indicator. It has "off," "low," and "high" position.

Range Gradient 124 is a series of displayed numbers, with zero setting 126, from "40" to "400" meters in increments of "20" meters. Range gradient 124 allows the grenadier to set the distance to the target (not shown). When set to a specific range, mount 111 sets the proper angle for the sight(s) to match the trajectory of the 40 mm round for the chosen range. This allows the grenadier to engage the intended target quickly and effectively with a higher degree of accuracy. Also, the "00" setting 126 can be used to engage targets with the weapon (not shown) to which mount 111 may be attached. The range gradient 124 can be back-illuminated by positioning the selector switch 122 in the "low" or "high" setting to assist the grenadier in viewing the range gradient 124 at night with the use of NVGs (which can optionally mounted to Picatinny rail 118 or the naked eye, respectively.

Mount 111 provides the grenadier an easy and quick cue, to determine that the weapon is oriented properly before firing a round. When the selector switch 122 is in the "low" or "high" setting, the indicator light illuminates and flashes when the weapon is properly oriented, with no tilt (cant) left or right. The indicator light 104 is designed to be detectable by the grenadier with NVGs in the "low" setting and with the naked eye in the "high" setting. The indicator light 104 is shrouded to prevent off angle viewing by forward onlookers or observers.

Pivot plate 128 is designed to be moved by the grenadier to set the range for mount 111. This is accomplished by use of pivot plate release lever 106. Contained within pivot plate 128 is gradient viewing window 126, which shows the range that is set by the grenadier. Beveled edge 129 around window 126 allows for viewing of the set range at off-angles by the grenadier. Pivot plate release lever 106 allows the grenadier the ability to move and set the range on mount 111. There are two positions the pivot plate release lever are designed to be set at: 1.) The 12 o'clock (un-lock) position 106 (shown in FIG. 5) allows for movement of the pivot plate to change the range setting and, 2.) The 6 o'clock (Locked) position 107 locks the pivot plate in place for the range selection and firing. The trajectory plate 108 is affixed to the rear of the base plate 125. The trajectory plate 108 contains precision notches 171 corresponding to specific ranges displayed on the range gradient 124.

Figure 4:
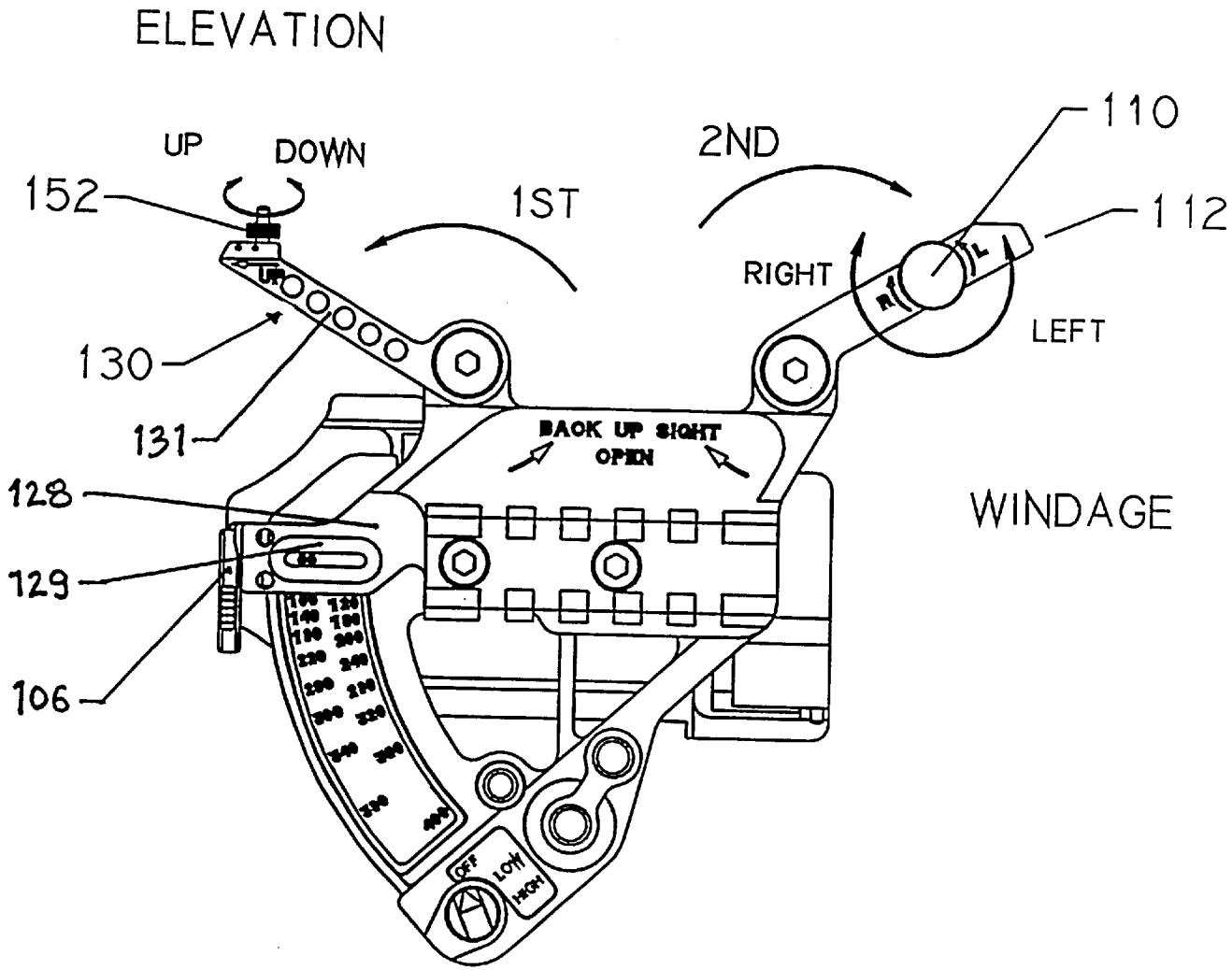
FIG. 4 is a left side view of the grenade launcher sighting assembly showing the iron sights opened and ready for use.
Figure 6:
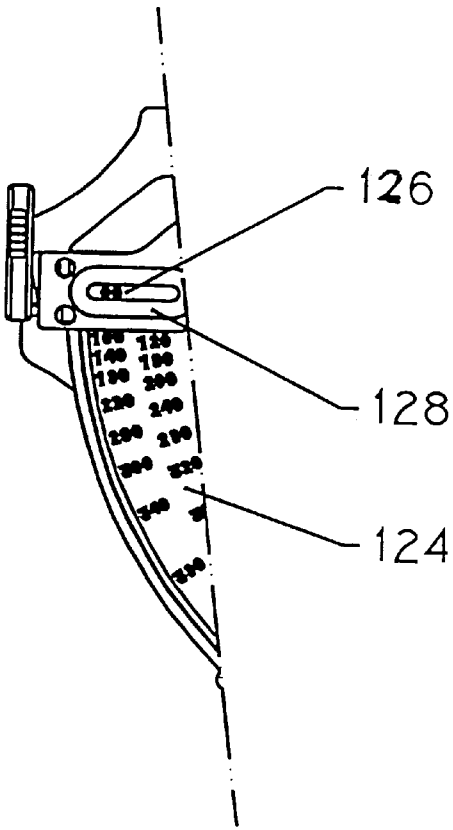
FIG. 6 is a detailed view of the gradient viewing window.
Figure 5:
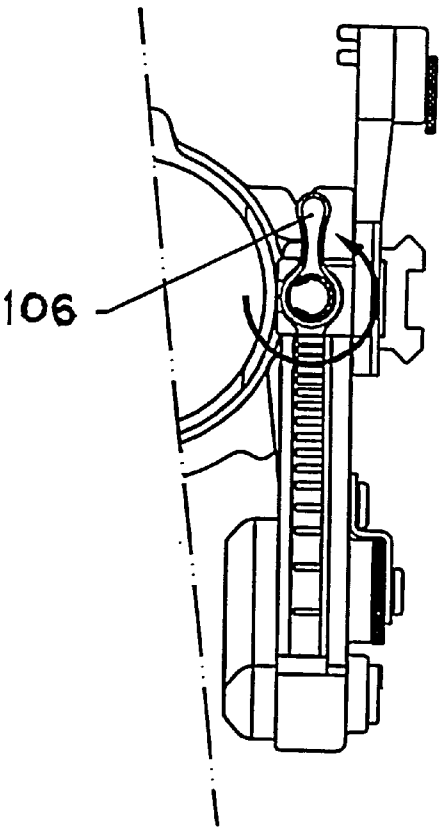
FIG. 5 is a detailed front of the pivot plate release lever.

The rear sight aperture assembly 112 and rear sight assembly 130 are part of the back-up iron sight built in for daytime use. When not in use, these assemblies are folded forward and stored in a collapsed position to protect them from rough handling and to retain aperture sight setting. When open as shown in FIG. 4, the front sight assembly 130 and rear sight assembly 112 are aligned to one another and can provide daytime sighting. Note that front sight aperture assembly 130 is folded first and rear sight assembly is folded second. Windage adjustment knob 110 allows controlled movement (left and right) to the rear aperture. This can be used to zero the back-up iron sight to the weapon or for windage adjustment. Note: The windage adjustment knob 110 is considered part of the rear sight aperture assembly 112.

Front sight assembly 130 comprises post arm 131 is part and front elevation sight post 152. Front elevation sight post 131 is located in the front sight post arm 131 and allows for controlled adjustment (up and down). This can be used to zero the back-up iron sight to the weapon. Note: The front sight post arm and front elevation sight post combined are the front sight assembly.

Figure 8:
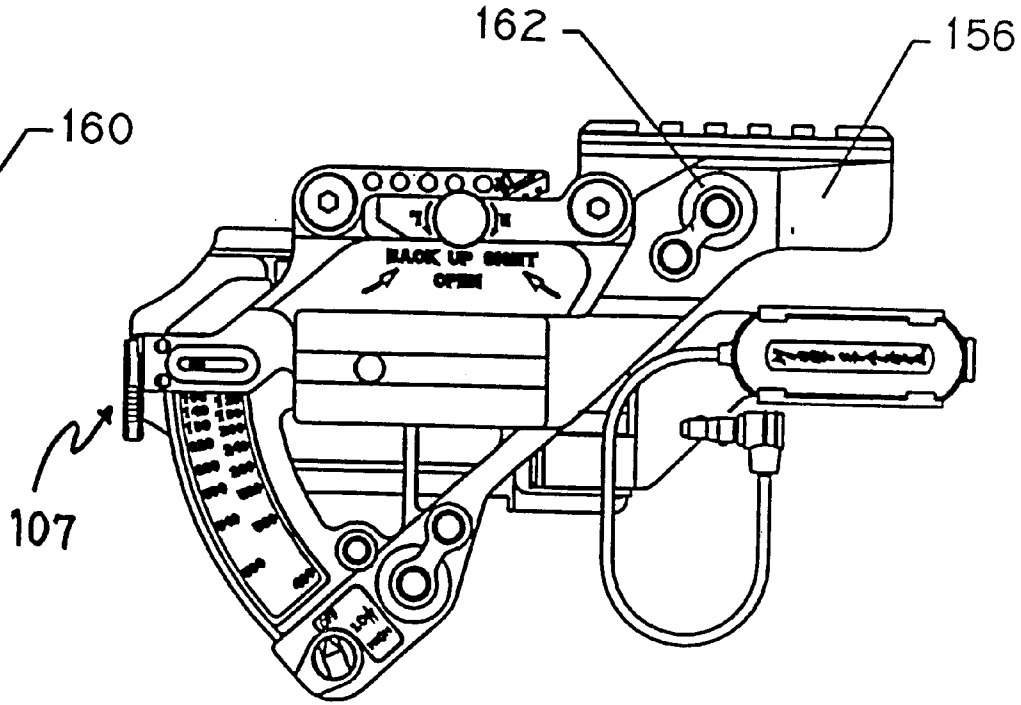
FIG. 8 is a side view of the L-bracket shown mounted on the grenade launcher sighting assembly.
Figure 7:
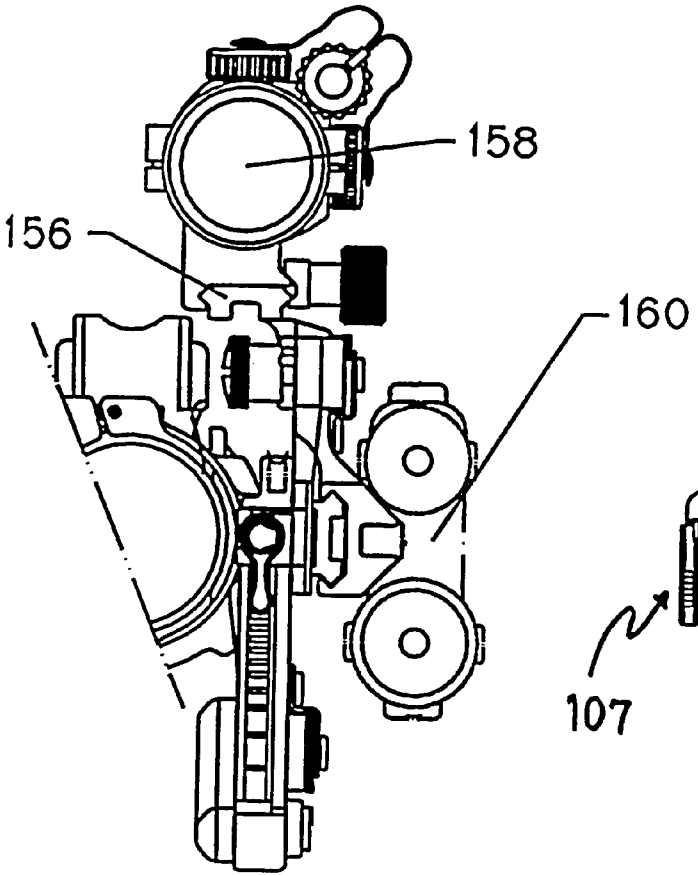
FIG. 7 is a front of the optional L-bracket shown mounted on the grenade launcher sighting assembly with the laser or reflex sights attached on the top and side of the L-bracket.

As shown in FIGS. 7 and 8, L-bracket 156 having top and side Mil-std-1913 Picatinny rails 118 allows for attachment of numerous optic sighting devices 160 (shown in FIG. 7), such as a laser (infrared, visible), reflex sight as well as the Wilcox M203 Enhanced Fire Control (MEFG). L-Bracket 156 is locked onto the grenade launcher assembly 111 via its rail 118. Auxiliary battery 162 is provided in order to handle the increased electronic requirements due to the additional accessories that may be attached.

Figure 11:
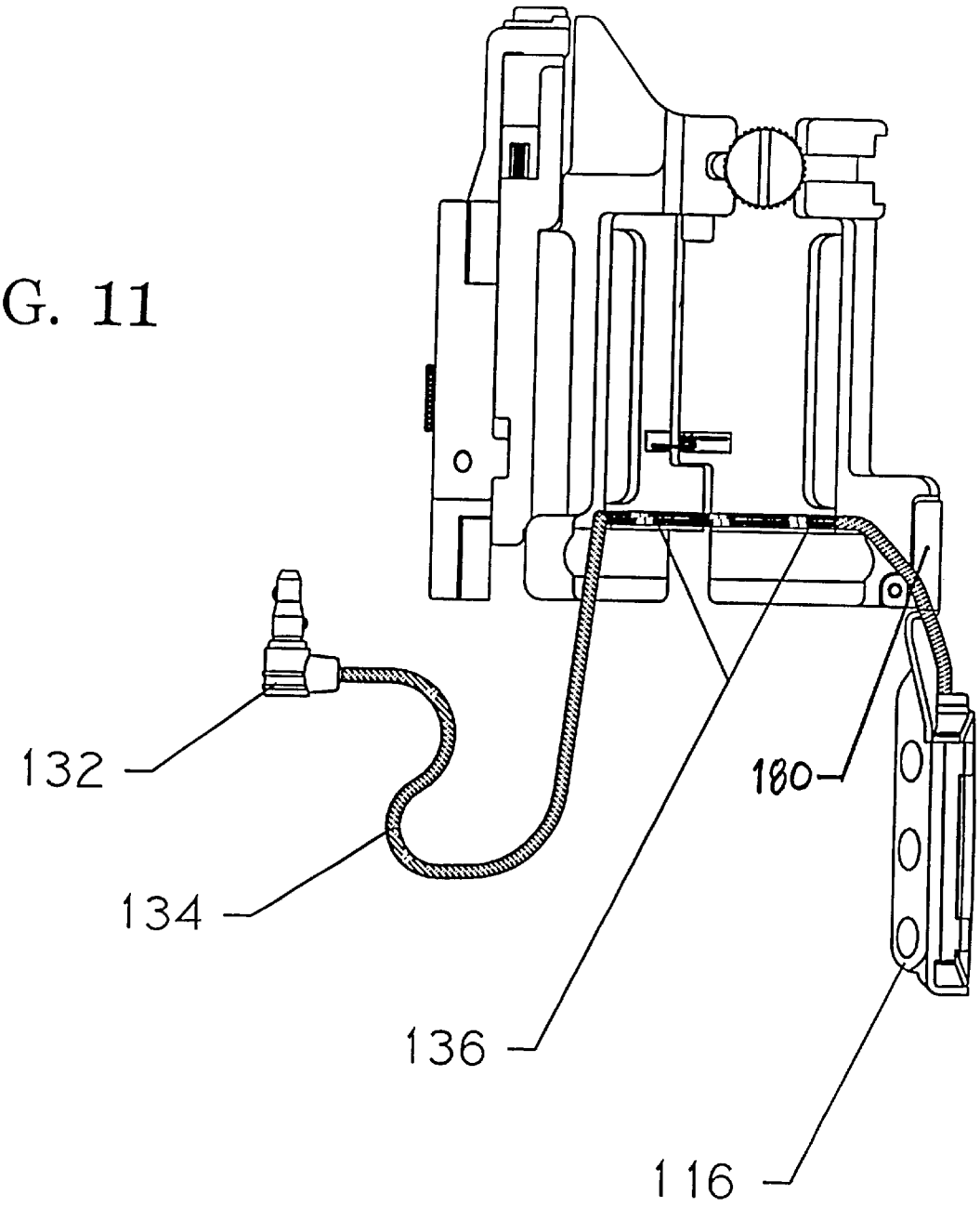
FIG. 11 is a bottom view of the grenade launcher sighting assembly.

As shown in FIG. 11, right holder 180 is designed to house and position pressure pad 116 on mount 111 without the use of tools. Left holder 181 is similarly designed to house and position pressure pad 116 on the left side so that pressure pad 116 is ambidextrous. Pressure Pad 116 is used for activation of a laser and other optical devices with a mating style of plug port corresponding to plug connector 132. An optical devices is activated by merely pressing on pad 116. The plug connector 132 on the pressure pad 116 fits the AN/PEQ-2, AN/PAW-4C, CVL, NightStalker Laser Sighting Module, and other devices. As shown in FIG. 11, cable 134 fits within slot 136 so that cable 134 will not be loose when pressure pad 116 is mounted on right holder 180.

The Battery Cap 120 together with an o-ring (not shown) seals the battery compartment, so the mount can be used underwater as well as in other harsh environments, typical with military use. The battery cap tether 187 connects the battery cap 120 to the base plate 125 to prevent loss of the battery cap 120 while changing the battery. Note: The battery compartment holds (one) DL ⅓ N size or equivalent lithium battery, common to the CCO and MGO optic devices used by the military.

Figure 14:
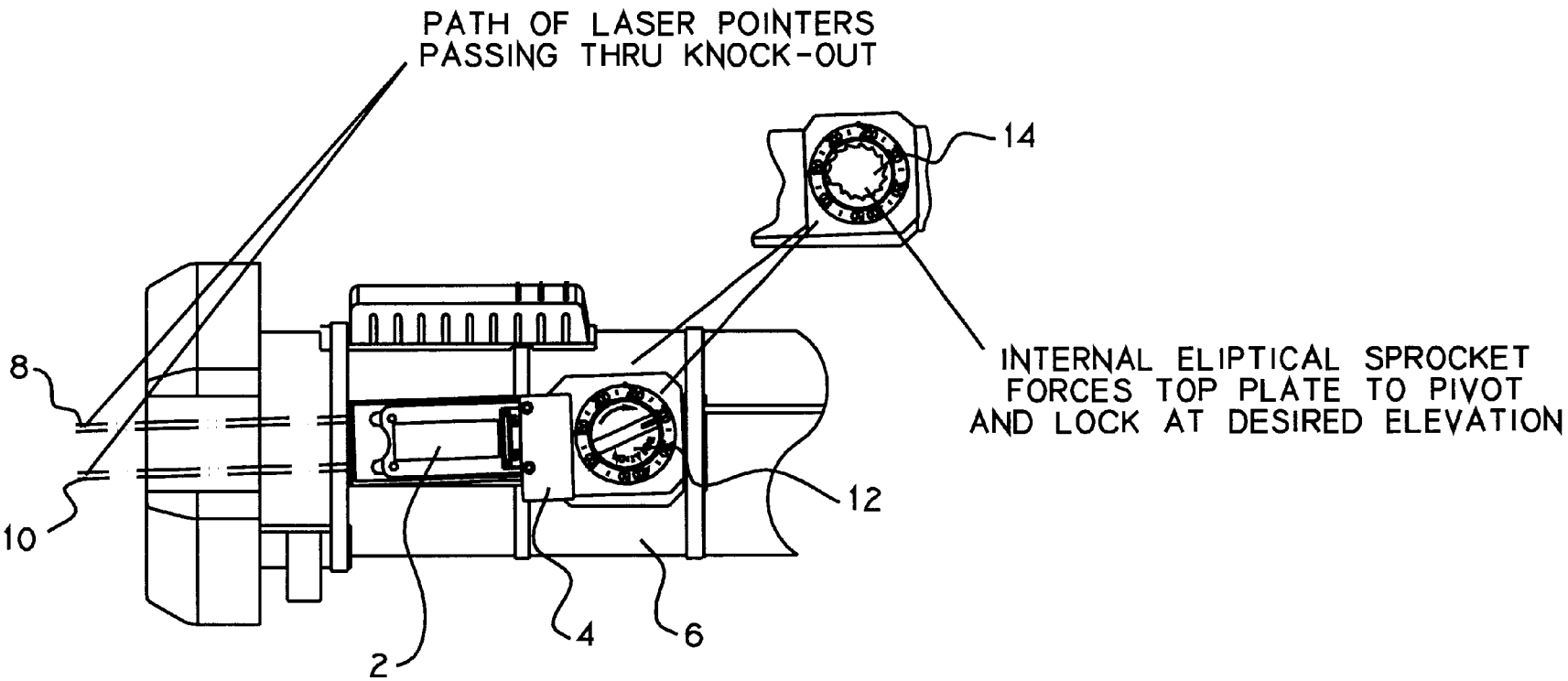
FIG. 14 is a side view of the laser and mounting modules of an alternative embodiment of the present invention mounted to a SMAW-D/CLAW disposable weapon.
Figure 15:
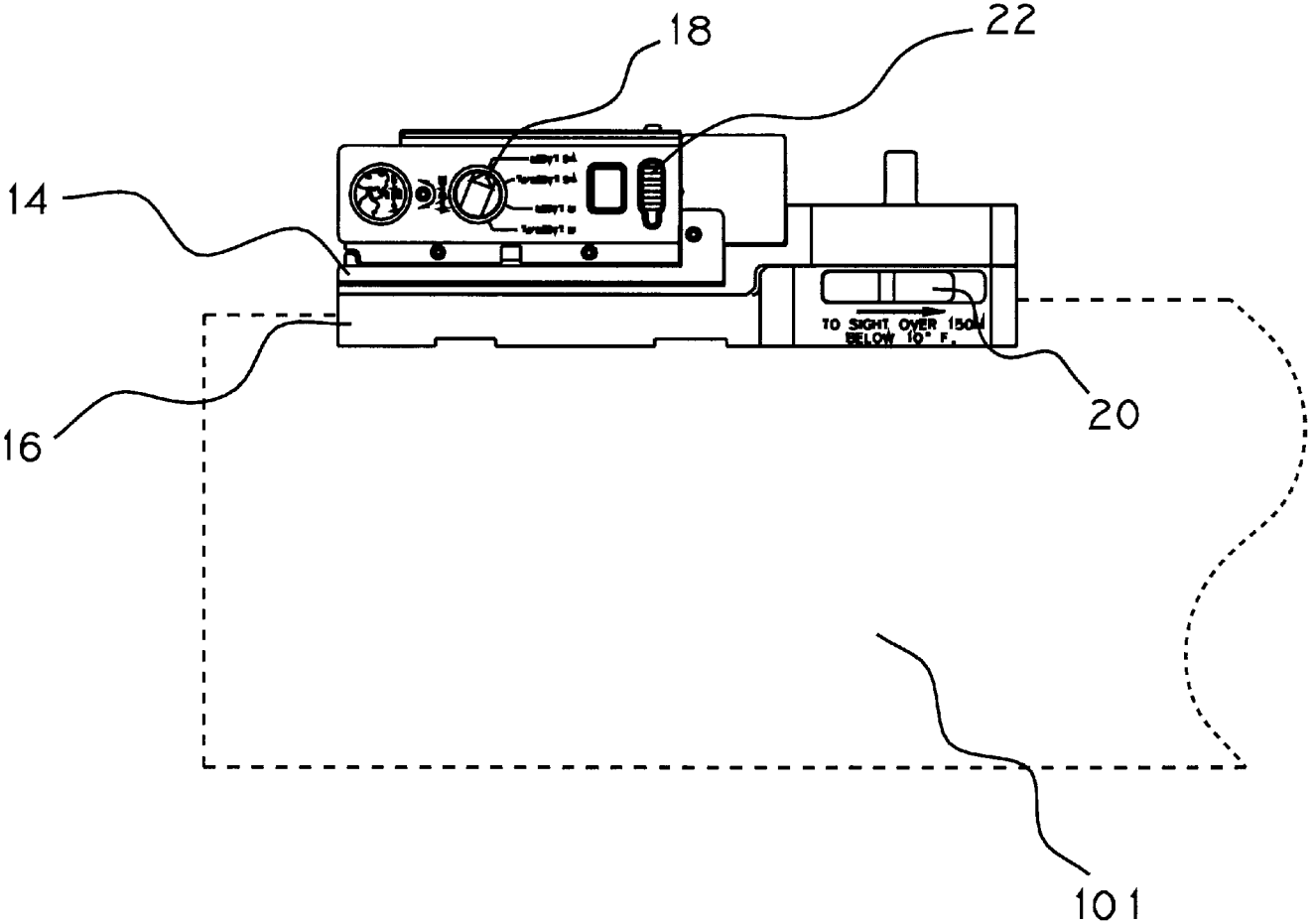
FIG. 15 is a top view of the laser and mounting modules of FIG. 2 with the weapon cut away.

Referring first to FIGS. 14 & 15, a side view and bottom view of the laser module 2 and an alternative embodiment of mounting module 4 attached to the side of a SMAW-D/CLAW disposable weapon 6 is shown. The laser module 2 emits a visible laser beam 8 and an infrared laser beam 10 which, when used at night, illuminates a target at a given distance away. The mode of the laser is controlled by a switch 18. The laser module 2 is detachably mounted to the mounting module 4 such that it is free to rotate with the mounting module 4, but remains in a predetermined position relative to the mounting module 4. In this embodiment, the mounting module 4 comprises two plates 14, 16 (See FIG. 15) that pivot relative to one another in response to changes in the position of range finder 12. Range finder 12 is adapted to allow the laser to provide an accurate target at a variety of distances. Range finder 12 utilizes an internal elliptical sprocket 14 that forces the top plate to pivot and lock in a desired position. The dimensions of sprocket 14 are variable depending upon the maximum range of the weapon being fired, the muzzle velocity of the projectile being fired and the shape of the projectile. In addition, a low temperature sighting feature allows a user to compensate for variations in proper sighting caused by low temperatures.

In operation, a user would mount the laser module 2 to the mounting module 4, attach a power cord, not shown, and set the range finder 12 to the proper distance. A button (not shown) is then depressed activating the laser and allowing the user to aim the laser at the target. In the case of a weapon such as the SMAW-D/CLAW disposable weapon 6, the laser module 2 would subsequently be removed and the weapon's tube, with attached mounting module 4, discarded. The laser module 2 would then be attached to another weapon 6 and operated in a similar manner.

Figure 16:
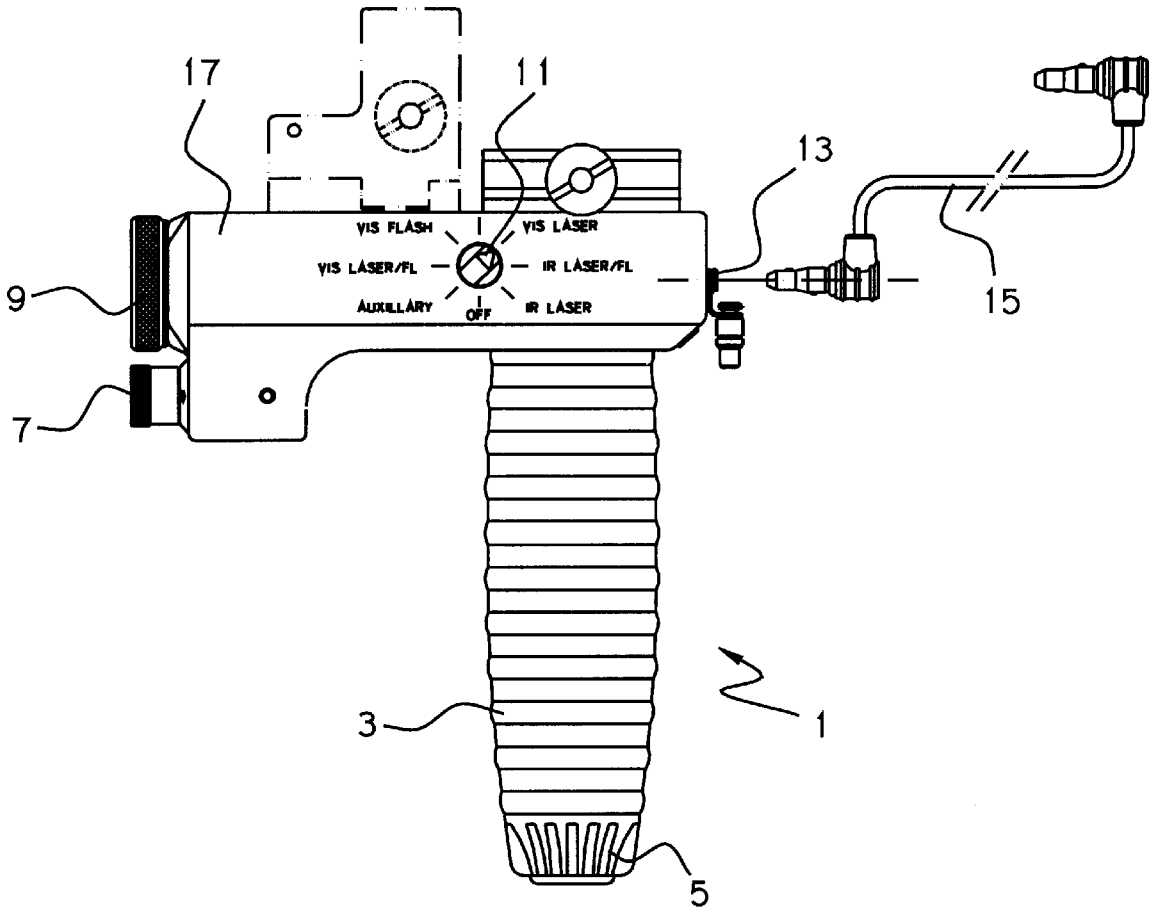
FIG. 16 is a side view of the handgrip assembly of the present invention.
Figure 17:
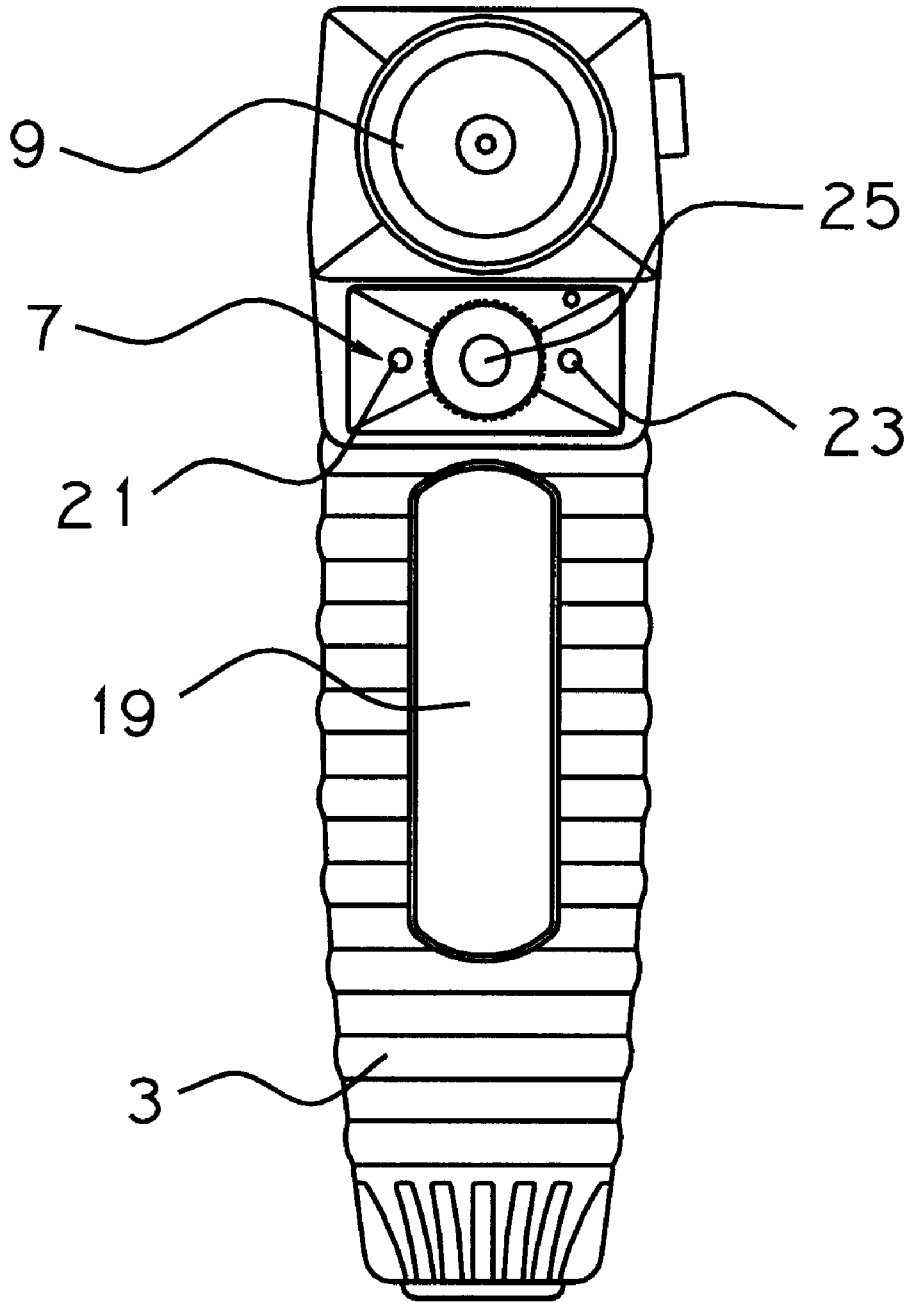
FIG. 17 is a front view of the handgrip assembly.

Referring now to FIG. 16, a side view of the handgrip assembly 1 is shown. The handgrip assembly 1 is adapted both to provide power to the laser module 2 mounted to the barrel of the weapon and to provide a stationary laser 7 and flashlight 9 for the weapon on which it is mounted. Handgrip assembly I comprises hollow handgrip 3, a base 17 which includes a selector switch I 1, internal laser module 7, flashlight module 9, and power ports 13, and a power cable 15.

Bottom cap 5 screws into threads (not shown) on hollow handgrip 3 and may be unscrewed to expose the battery compartment (not shown) within the hollow handgrip 3. In the preferred embodiment of the invention, handgrip assembly 1 is adapted for use with standard "N" size batteries, but other batteries may be adapted for use within this system and thus are contemplated by the invention.

Selector switch 11 allows the user to control the modes of the attached lasers and flashlight as well as to provide power to the auxiliary laser module 2 described above. Internal laser module 7 and flashlight 9 are mounted to the front face of the body and emit light from the front of the handgrip module. As shown more clearly in FIG. 5, laser module 7 includes an infrared laser 21, a visible laser 23 and an infrared flashlight 25 that are selectable from selector switch 11. Once a mode is selected, the light is activated by depressing pressure pad 19 in the front of hollow handgrip 3. By including an internal laser module 7 on the primary weapon, the laser module 2 described above may be transferred to other weapons or to other attachments to the primary weapon, such as the grenade launcher discussed above.

Figure 18:
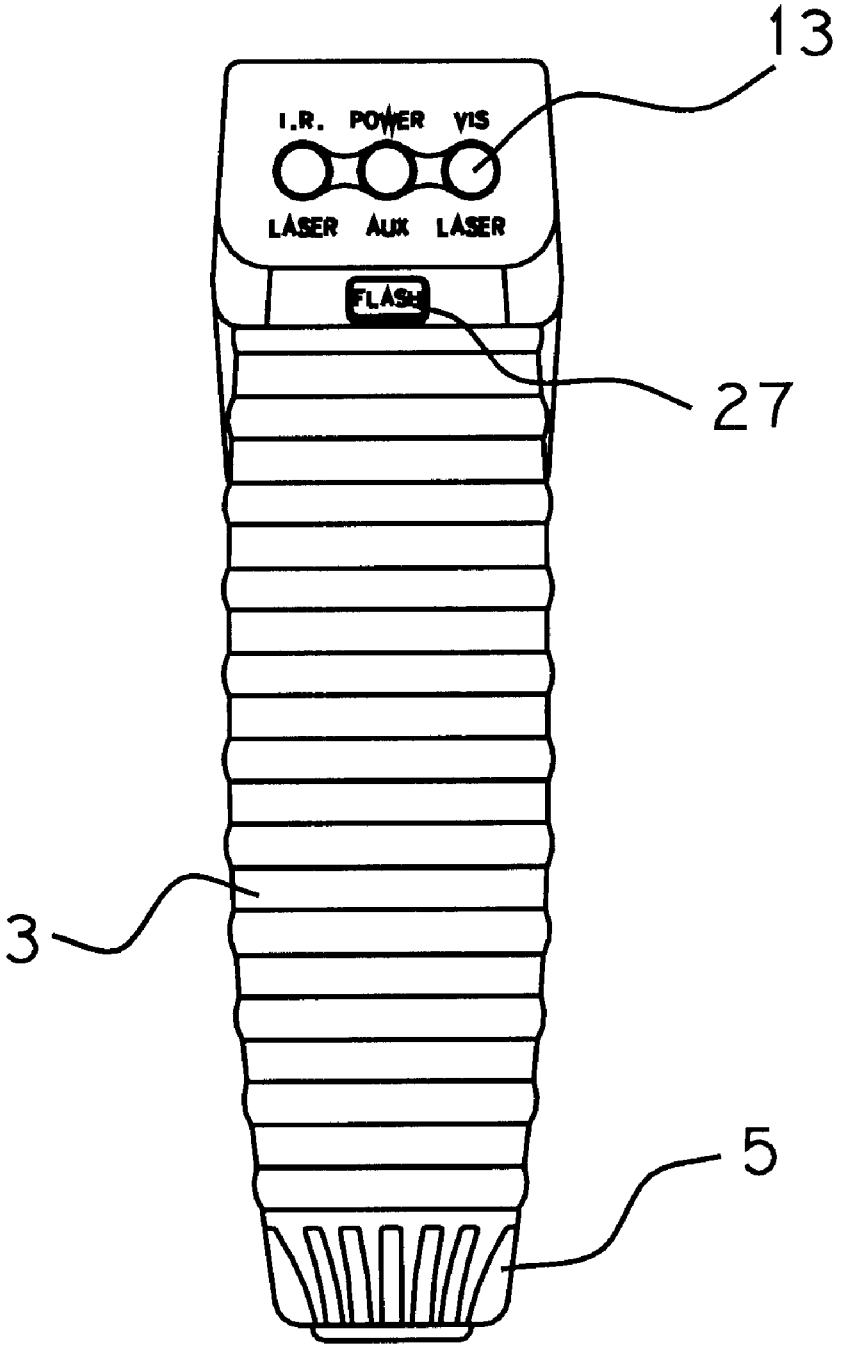
FIG. 18 is a back view of the handgrip assembly.

As shown more clearly in FIG. 18, power ports 13 are located at the back of handgrip 3 and include ports to connect to an external infrared laser, external visible laser and to auxiliary devices requiring power. This is an essential feature of this embodiment as it allows the handgrip to become a universal power source for any additional modules that may be developed or adapted for use with weaponry. Below power ports 13 is flashlight bypass button 27 which, when depressed, illuminates the flashlight regardless of the mode selected on the selector switch 11.

Figure 19:
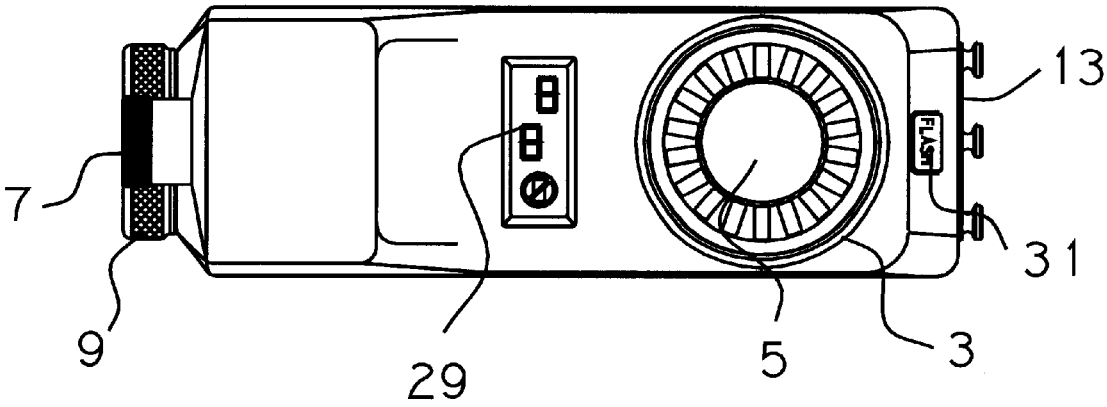
FIG. 19 is a bottom view of the handgrip assembly.

Referring now to FIG. 19, a bottom view of the handgrip assembly is shown. The handgrip bottom includes an additional flashlight bypass button 31 and an LCD monitor which displays the blink rate of the laser as well as the amount of power remaining in the battery. In the preferred embodiment of the invention, the LCD conforms to military specifications and is not backlit. However, this monitor may be backlit for other non-military applications.

It should be noted that though the laser module, mounting module and handgrip assembly have been presented together, the handgrip assembly may be utilized without also using the laser and mounting modules. Conversely, the laser and mounting modules may be utilized without the handgrip assembly to achieve similar results.

Although the present invention has been described in considerable detail with reference to certain preferred versions thereof, other versions would be readily apparent to those of ordinary skill in the art. Therefore, the spirit and scope of the claims should not be limited to the description of the preferred versions contained herein.

What is claimed is:

1. A sighting apparatus for a grenade launcher having a barrel with a centerline, said apparatus comprising:

a mounting module that is alignable mountable to the barrel of the grenade launcher, wherein said mounting module is adapted to be attached to the barrel of the grenade launcher such that mounting module is consistently aligned with the centerline of the barrel;

an adjustable illuminated range gradient pivotally attached to said mounting module;

an illumination switch wherein said range gradient has a day and night illumination setting and wherein said range gradient has selectable a plurality of selectable positions, such that each selectable position has a yardage value and such that each selectable position corresponds to a particular trajectory wherein said grenade launcher will launch a grenade a distance that corresponds to the yardage value of selected position of said range gradient.

2. The sighting apparatus of claim 1 further comprising a laser sight that is releasable mounted to said mounting module.

3. The sighting apparatus of claim 1 further comprising a reflex sight that is releasable mounted to said mounting module.

4. The sighting apparatus of claim 1 further comprising adjustable iron sights.

5. The sighting apparatus of claim 4 wherein said iron sights have a foldable position adjacent to said mounting module such that a low profile is maintained when said iron sights are in the foldable position.

6. The sighting apparatus of claim 5 wherein said iron sights have a forward sight post arm having an elevation adjustment and a rear sight post arm having a windage adjustment.

7. The sighting apparatus of claim 1 further comprising an illuminated anti-cant indicator which indicates, via a flashing light, when said grenade launcher is properly positioned.

8. The sighting apparatus of claim 1 further an ambidextrous pressure pad switch adapted to activate devices having a plug port.

9. The sighting apparatus of claim 1 further comprising a battery compartment sealable via a tethered battery cover.

10. The sighting apparatus of claim 9 further comprising an o-ring seal such that said sighting apparatus can be used underwater and under harsh environmental conditions.

11. The sighting apparatus of claim 1 further comprising a Picatinny rail having a centerline and meeting 19–13 mil std specifications.

12. The sighting apparatus of claim 11 wherein one of said plurality of selectable positions of said adjustable range gradient places the centerline of said Picatinny rail in substantial alignment with the centerline of said grenade launcher such that when said grenade launcher is mounted on a rifle, a laser sight mounted on said Picatinny rail of said sighting apparatus can also be used as a sight for said rifle as well as a sight for said grenade launcher.

13. The sighting apparatus of claim 1 wherein said mounting module further comprises a spring loaded locking mechanism such that said mounting module can be mounted to the barrel of said grenade launcher by hand.

14. The sighting apparatus of claim 13 wherein the barrel of said grenade launcher has a plurality of ribs and wherein said mounting module further comprises a shoulder dimensioned to mate with one of the ribs of said grenade launcher such that said mounting module is prevented from creeping along the barrel of said grenade launcher during use.

15. The sighting apparatus of claim 1 further comprising a L-bracket releasable mountable to said sighting apparatus and having at least one Picatinny rail meeting 19–13 mul std specifications such that at least one electronic sight is mountable thereon.

* * * * *